US009918509B2

(12) United States Patent
Moreno

(10) Patent No.: US 9,918,509 B2
(45) Date of Patent: Mar. 20, 2018

(54) VENTILATED HELMET ASSEMBLY

(71) Applicant: Juan Moreno, North Bergen, NJ (US)

(72) Inventor: Juan Moreno, North Bergen, NJ (US)

( * ) Notice: Subject to any disclaimer, the term of this patent is extended or adjusted under 35 U.S.C. 154(b) by 0 days.

(21) Appl. No.: 15/205,867

(22) Filed: Jul. 8, 2016

(65) Prior Publication Data

US 2018/0007993 A1 Jan. 11, 2018

(51) Int. Cl.
*A42B 1/06* (2006.01)
*A42B 3/28* (2006.01)
*A42B 3/12* (2006.01)

(52) U.S. Cl.
CPC ..... *A42B 3/286* (2013.01); *A42B 3/125* (2013.01)

(58) Field of Classification Search
CPC ..... A43B 3/286; A43B 3/125
See application file for complete search history.

(56) References Cited

U.S. PATENT DOCUMENTS 3,813,696 A * 6/1974 Yeager ..... A42B 3/286 2/171.3
5,054,480 A * 10/1991 Bare ..... A41D 13/11 128/201.25
5,533,500 A * 7/1996 Her-Mou ..... A62B 18/045 128/201.24
5,561,862 A * 10/1996 Flores, Sr. ..... A42B 3/286 2/171.3
5,655,374 A * 8/1997 Santilli ..... A41D 13/1218 2/905
5,696,356 A * 12/1997 Dudley ..... A42B 3/0406 181/129
5,839,121 A * 11/1998 Morales ..... A42B 3/281 2/209.7
6,081,929 A * 7/2000 Rothrock ..... A42B 3/286 2/171.3
D525,393 S * 7/2006 Harris ..... D29/107
7,114,194 B2 * 10/2006 English ..... A42B 3/286 2/171.3
7,296,304 B2 * 11/2007 Goldsborough ..... A42B 3/285 2/171.3
7,748,059 B2 * 7/2010 Arai ..... A42B 3/0493 2/171.3
7,802,318 B2 9/2010 Chen
8,136,169 B2 * 3/2012 Taylor ..... A42B 1/008 2/171.3
8,695,121 B2 * 4/2014 Nolan ..... A42B 3/24 2/171.3
8,756,715 B1 6/2014 Moffitt, Jr.
8,973,173 B2 3/2015 Elam et al.
2005/0108807 A1 * 5/2005 Ahn ..... A42B 3/0433 2/171.3
2005/0132468 A1 * 6/2005 Lundgren ..... A42C 5/04 2/171.3
2007/0113324 A1 * 5/2007 Chen ..... A42B 3/044 2/424

(Continued)

FOREIGN PATENT DOCUMENTS

WO WO2015064926 5/2015

*Primary Examiner* — Richale Quinn

(57) ABSTRACT

A ventilated helmet assembly for cooling a user when the user wears a helmet includes a helmet that may be worn on a head. A ventilation unit is coupled to the helmet. The ventilation unit may urge air inwardly and outwardly from the helmet. Thus, the ventilation unit may cool the user when the user wears the helmet.

7 Claims, 4 Drawing Sheets

(56) References Cited

U.S. PATENT DOCUMENTS

| | | | | |
|---|---|---|---|---|
| 2011/0219506 | A1* | 9/2011 | Uttrachi | A61F 9/067 2/8.6 |
| 2011/0231977 | A1* | 9/2011 | Rupnick | A42B 3/286 2/7 |

* cited by examiner

VENTILATED HELMET ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to helmet devices and more particularly pertains to a new helmet device for cooling a user when the user wears a helmet.

BRIEF SUMMARY OF THE INVENTION

An embodiment of the disclosure meets the needs presented above by generally comprising a helmet that may be worn on a head. A ventilation unit is coupled to the helmet. The ventilation unit may urge air inwardly and outwardly from the helmet. Thus, the ventilation unit may cool the user when the user wears the helmet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
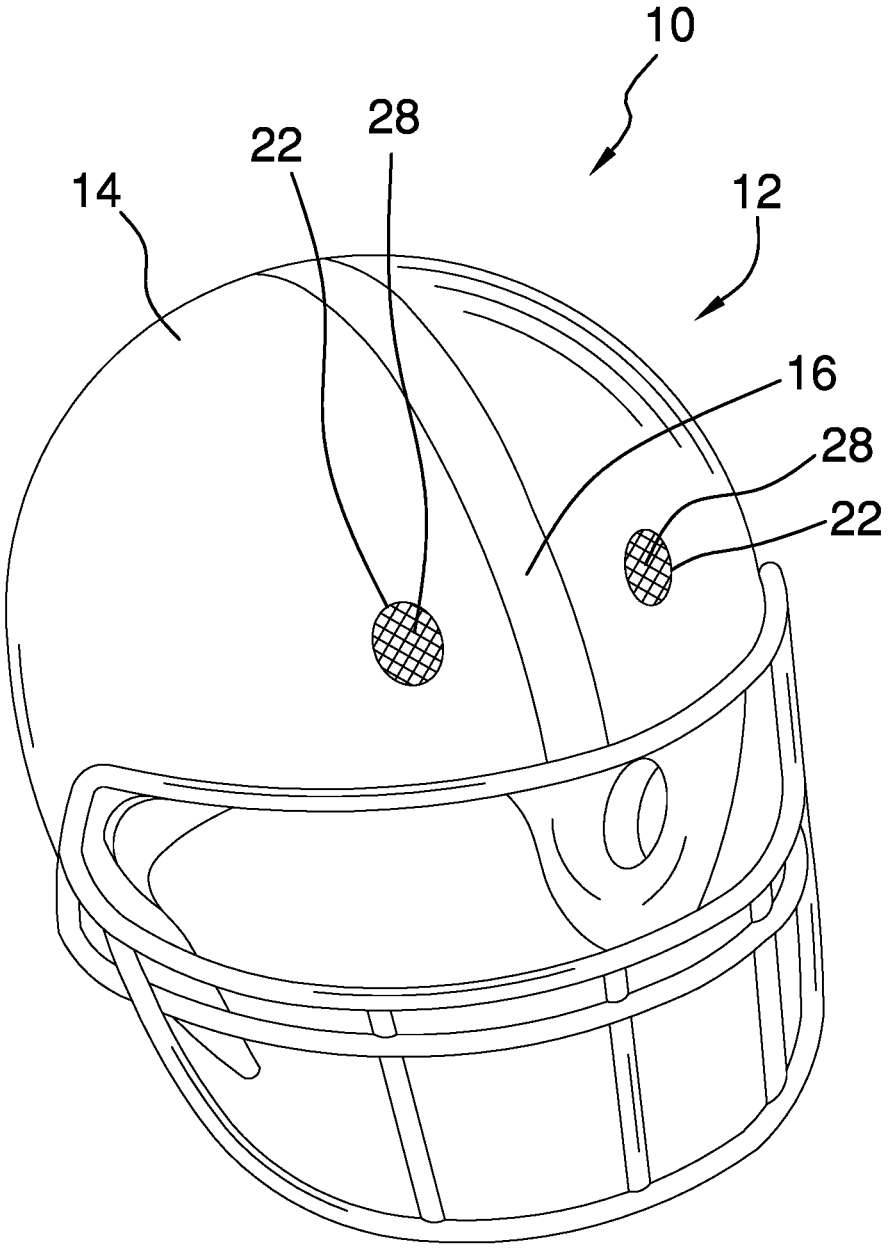
FIG. 1 is a front perspective view of a ventilated helmet assembly according to an embodiment of the disclosure.
Figure 2:
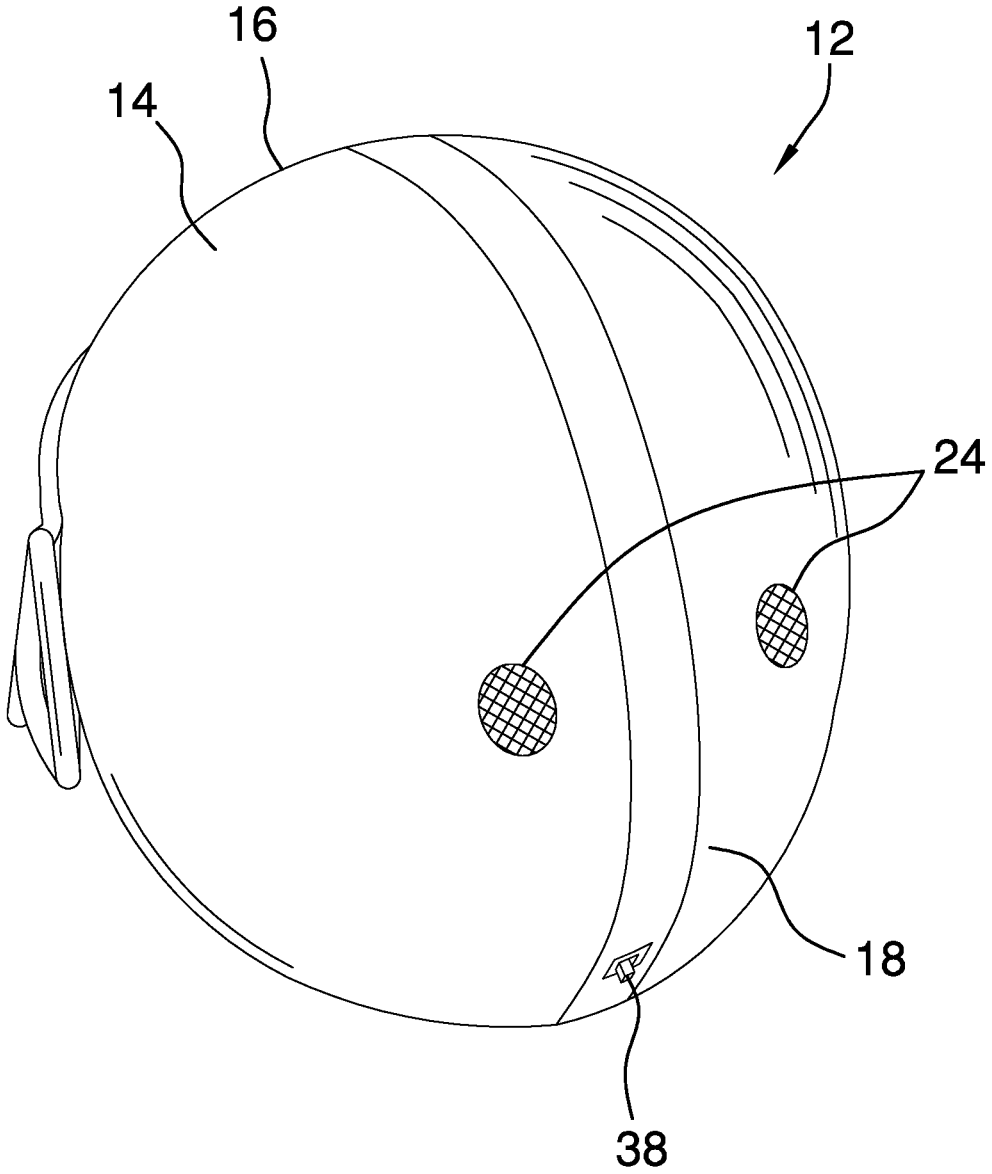
FIG. 2 is a back perspective view of an embodiment of the disclosure.
Figure 3:
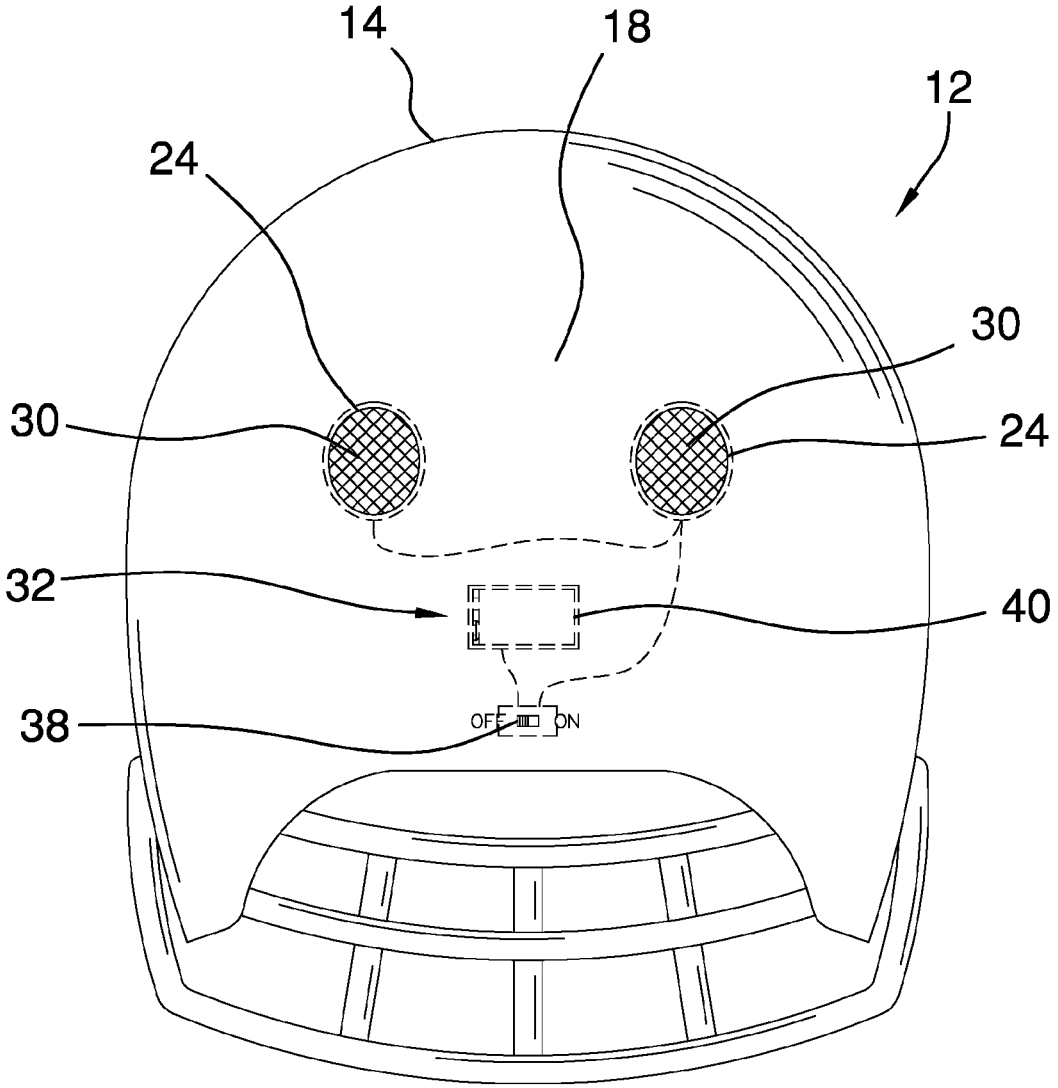
FIG. 3 is a back phantom view of an embodiment of the disclosure.
Figure 4:
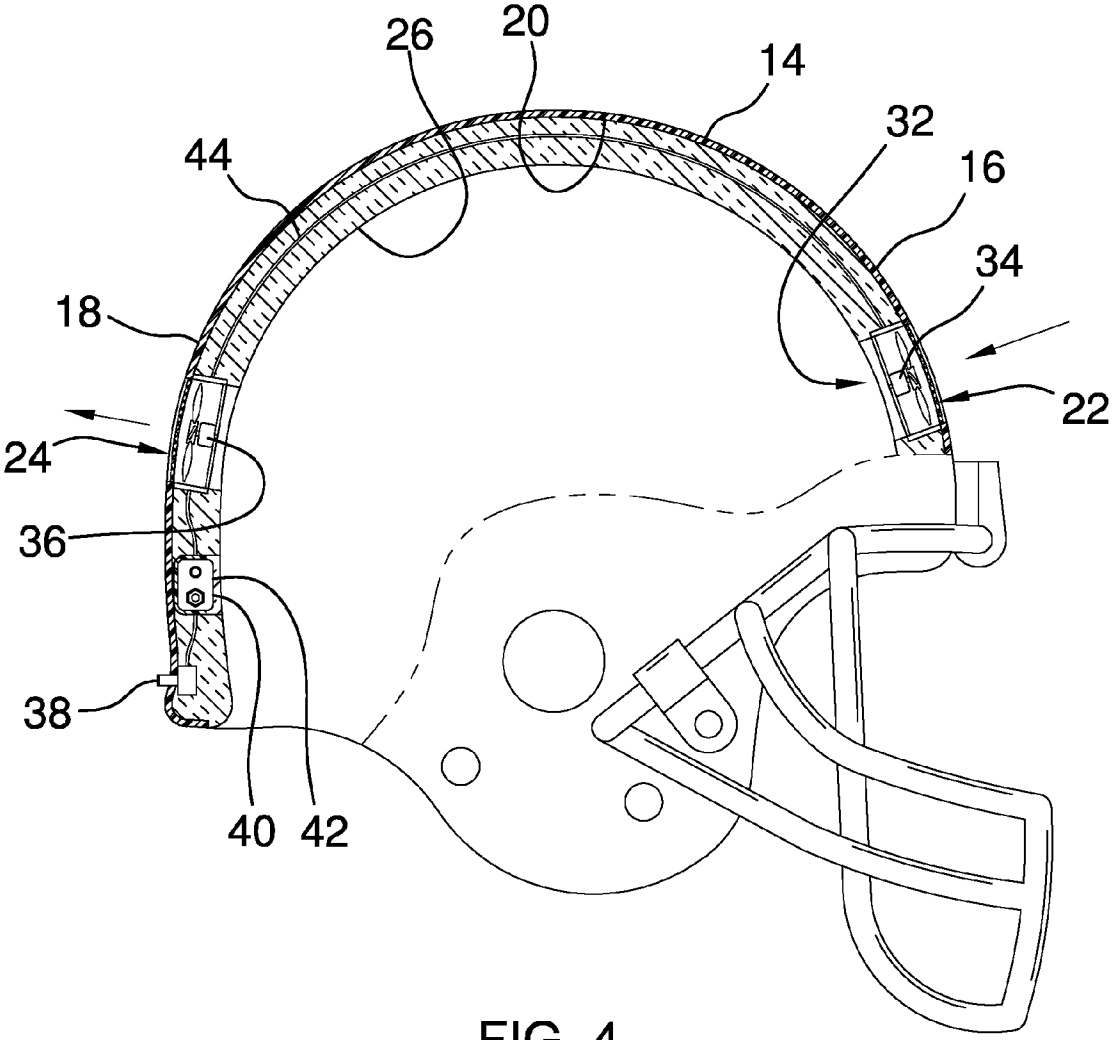
FIG. 4 is a cross sectional view taken along line 4-4 of FIG. 1 of an embodiment of the disclosure.

With reference now to the drawings, and in particular to FIGS. 1 through 4 thereof, a new helmet device embodying the principles and concepts of an embodiment of the disclosure and generally designated by the reference numeral 10 will be described.

As best illustrated in FIGS. 1 through 4, the ventilated helmet assembly 10 generally comprises a helmet 12 that may be worn on a head of a user. The helmet 12 has an outer wall 14 and the outer wall 14 is continuous such that the helmet 12 has a substantially hemispherical shape. The outer wall 14 has a front side 16, a back side 18 and an inner surface 20. The front side 16 is substantially open. Thus, the front side 16 may expose a face of a user when the helmet 12 is worn. The helmet 12 may comprise a football helmet 12 or the like.

The outer wall 14 has a pair of intakes 22 extending therethrough and each of the intakes 22 may have air pass therethrough. Each of the intakes 22 is positioned on the front side 16 and the intakes 22 are spaced apart from each other. The helmet 12 has a pair of exhausts 24 extending therethrough and each of the exhausts 24 may have air pass therethrough. Each of the exhausts 24 is positioned on the back side 18 and the exhausts 24 are spaced apart from each other.

A pad 26 may be provided and the pad 26 may be coupled to the inner surface 20 of the helmet 12. The pad 26 may completely cover the inner surface 20 of the helmet 12. Each of the intakes 22 and the exhausts 24 may extend through the pad 26. The pad 26 may be comprised of a resiliently compressible material.

A pair of first screens 28 may be provided and each of the first screens 28 may be coupled to the outer wall 14 of the helmet 12. Each of the first screens 28 may cover an associated one of the intakes 22. Thus, each of the first screens 28 may inhibit debris from passing through the intakes 22. A pair of second screens 30 may be provided and each of the second screens 30 may be coupled to the outer wall 14 of the helmet 12. Each of the second screens 30 may cover an associated one of the exhausts 24. Thus, each of the second screens 30 may inhibit debris from passing through the exhausts 24.

A ventilation unit 32 is provided. The ventilation unit 32 is coupled to the helmet 12. The ventilation unit 32 may urge air inwardly and outwardly from the helmet 12. Thus, the ventilation unit 32 may cool the user when the user wears the helmet 12.

The ventilation unit 32 comprises a pair of intake fans 34 and each of the intake fans 34 is coupled to the inner surface 20 of the helmet 12. Each of the intake fans 34 is aligned with an associated one of the intakes 22. Thus, each of the intake fans 34 may urge air inwardly through the associated intake. Each of the intake fans 34 may comprise an electric fan or the like.

A pair of exhaust fans 36 is provided and each of the exhaust fans 36 is coupled to the inner surface 20 of the helmet 12. Each of the intake fans 34 is aligned with an associated one of the exhausts 24. Thus, each of the exhaust fans 36 may urge air outwardly through the associated exhaust. Each of the exhaust fans 36 may comprise an electric fan or the like.

A switch 38 is coupled to the helmet 12 and the switch 38 may be manipulated. The switch 38 is electrically coupled to each of the intake fans 34 and each of the exhaust fans 36. Thus, the switch 38 selectively turns each of the intake fans 34 and each of the exhaust fans 36 on and off. The switch 38 may be positioned on the back side 18 of the helmet 12.

A power supply 40 is coupled to the helmet 12. The power supply 40 is electrically coupled to the switch 38. The power supply 40 comprises at least one battery 42. The power supply 40 may be recessed into the pad 26. At least one conductor 44 may be provided. The at least one conductor 44 may be electrically coupled between the switch 38, the power supply 40, each of the intake fans 34 and each of the exhaust fans 36. The at least one conductor 44 may be positioned within the pad 26.

In use, the helmet 12 is worn. The switch 38 is manipulated to turn each of the intake fans 34 and each of the exhaust fans 36 on. Thus, the user is cooled when the user wears the helmet 12. The switch 38 is manipulated to turn each of the intake fans 34 and each of the exhaust fans 36 off at a selected time.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A ventilated helmet assembly being configured to cool a user's head, said assembly comprising:

a helmet being configured to be worn on a head, said helmet having a pair of intakes; and a ventilation unit being coupled to said helmet wherein said ventilation unit is configured to urge air inwardly and outwardly from said helmet thereby facilitating said ventilation unit to cool the user when the user wears said helmet, said ventilation unit including a pair of intake fans, each of said intake fans being coupled to an inner surface of said helmet, each of said intake fans being aligned with an associated one of said intakes wherein each of said intake fans is configured to urge air inwardly through said associated intake.

2. The assembly according to claim 1, wherein said helmet has an outer wall, said outer wall being continuous such that said helmet has a substantially hemispherical shape, said outer wall having a front side, a back side and said inner surface, said front side being substantially open wherein said front side is configured to expose a face of a user when the helmet is worn, said outer wall having said pair of intakes extending therethrough wherein each of said intakes is configured to have air pass therethrough, each of said intakes being positioned on said front side, said intakes being spaced apart from each other.

3. The assembly according to claim 2, wherein said helmet has a pair of exhausts extending therethrough wherein each of said exhausts is configured to have air pass therethrough, each of said exhausts being positioned on said back side, said exhausts being spaced apart from each other.

4. The assembly according to claim 1, wherein:

said helmet has a pair of exhausts; and said ventilation unit comprises a pair of exhaust fans, each of said exhaust fans being coupled to said inner surface of said helmet, each of said intake fans being aligned with an associated one of said exhausts wherein each of said exhaust fans is configured to urge air outwardly through said associated exhaust.

5. A ventilated helmet assembly being configured to cool a user's head, said assembly comprising:

a helmet being configured to be worn on a head;

a ventilation unit being coupled to said helmet wherein said ventilation unit is configured to urge air inwardly and outwardly from said helmet thereby facilitating said ventilation unit to cool the user when the user wears said helmet;

a pair of intake fans;

a pair of exhaust fans; and a switch being coupled to said helmet wherein said switch is configured to be manipulated, said switch being electrically coupled to each of said intake fans and each of said exhaust fans such that said switch selectively turns each of said intake fans and each of said exhaust fans on and off.

6. The assembly according to claim 5, further comprising a power supply being coupled to said helmet, said power supply being electrically coupled to said switch, said power supply comprising at least one battery.

7. A ventilated helmet assembly being configured to cool a user's head, said assembly comprising:

a helmet being configured to be worn on a head, said helmet having an outer wall, said outer wall being continuous such that said helmet has a substantially hemispherical shape, said outer wall having a front side, a back side and an inner surface, said front side being substantially open wherein said front side is configured to expose a face of a user when the helmet is worn, said outer wall having a pair of intakes extending therethrough wherein each of said intakes is configured to have air pass therethrough, each of said intakes being positioned on said front side, said intakes being spaced apart from each other, said helmet having a pair of exhausts extending therethrough wherein each of said exhausts is configured to have air pass therethrough, each of said exhausts being positioned on said back side, said exhausts being spaced apart from each other; and a ventilation unit being coupled to said helmet wherein said ventilation unit is configured to urge air inwardly and outwardly from said helmet thereby facilitating said ventilation unit to cool the user when the user wears said helmet, said ventilation unit comprising:

a pair of intake fans, each of said intake fans being coupled to said to said inner surface of said helmet, each of said intake fans being aligned with an associated one of said intakes wherein each of said intake fans is configured to urge air inwardly through said associated intake, a pair of exhaust fans, each of said exhaust fans being coupled to said inner surface of said helmet, each of said intake fans being aligned with an associated one of said exhausts wherein each of said exhaust fans is configured to urge air outwardly through said associated exhaust, a switch being coupled to said helmet wherein said switch is configured to be manipulated, said switch being electrically coupled to each of said intake fans and each of said exhaust fans such that said switch selectively turns each of said intake fans and each of said exhaust fans on and off, and a power supply being coupled to said helmet, said power supply being electrically coupled to said switch, said power supply comprising at least one battery.

* * * * *